US008630575B2

(12) United States Patent
Ideguchi

(10) Patent No.: US 8,630,575 B2
(45) Date of Patent: Jan. 14, 2014

(54) IMAGE FORMING APPARATUS

(75) Inventor: Takuro Ideguchi, Munich (DE)

(73) Assignee: Canon Kabushiki Kaisha, Tokyo (JP)

( * ) Notice: Subject to any disclaimer, the term of this patent is extended or adjusted under 35 U.S.C. 154(b) by 64 days.

(21) Appl. No.: 13/296,600

(22) Filed: Nov. 15, 2011

(65) Prior Publication Data

US 2012/0128396 A1 May 24, 2012

(30) Foreign Application Priority Data

Nov. 18, 2010 (JP) ..... 2010-258189

(51) Int. Cl.
*G03G 15/00* (2006.01)
*B65H 29/54* (2006.01)
*B65H 29/70* (2006.01)

(52) U.S. Cl.
USPC ..... 399/397; 399/400; 271/308; 271/188

(58) Field of Classification Search
CPC ..... G03G 2215/1623; G03G 21/168; G03G 2215/00573
USPC ..... 399/397, 398, 400, 303; 271/308, 307, 271/312
See application file for complete search history.

(56) References Cited

U.S. PATENT DOCUMENTS 5,666,621 A * 9/1997 Maekawa et al. ..... 399/303

FOREIGN PATENT DOCUMENTS

JP 5-119636 A 5/1993
JP 9-015987 A 1/1997

* cited by examiner

*Primary Examiner* — Ren Yan
*Assistant Examiner* — John M Royston
(74) *Attorney, Agent, or Firm* — Canon USA Inc IP Division

(57) ABSTRACT

The image forming apparatus comprising an image bearing member configured to carry a toner image and a rotatable belt member stretched by a plurality of stretching members and configured to carry and convey a recording material and a transfer member configured to transfer the toner image from the image bearing member to the recording material carried by the belt member by pressing the belt member against the image bearing member and a first lifting member arranged more downstream than the transfer member in a recording material conveyance direction, to which the recording material is conveyed, and configured to locally lift the belt member from the inside thereof in a width direction orthogonal to the recording material conveyance direction and a second lifting member arranged more downstream than the first lifting member in the recording material conveyance direction, is disclosed as one of the aspects of disclosures.

12 Claims, 10 Drawing Sheets

IMAGE FORMING APPARATUS

BACKGROUND OF THE INVENTION

1. Field of the Invention

The present invention relates to an image forming apparatus, such as a copying machine or a laser printer, which transfers a toner image carried by an image bearing member to a recording material using an electrophotographic technique. In particular, the present invention relates to an image forming apparatus including a transfer belt which performs transfer to a recording material and conveyance thereof.

2. Description of the Related Art

In an electrophotographic apparatus in which a recording material is carried and conveyed by a transfer belt stretched by a plurality of rollers, the recording material on the transfer belt passes a transfer nip portion and is electrostatically attracted to the transfer belt.

If the stiffness of the recording material is weak, the recording material cannot be separated from the transfer belt by merely using the curvature of a separation roller to stretch the transfer belt and the stiffness of the recording material. In other words, the recording material is kept stuck on the transfer belt at the position of the separation roller to cause a separation defect.

There has been a method for separating the recording material such that protrusions are uniformly formed on the separation roller stretching the transfer belt to provide a corrugation for the transfer belt at a separation position (refer to Japanese Patent Application Laid-Open No. 9-015987). The use of such a configuration allows the corrugation to be formed on the transfer belt at the separation position, however, great tension always locally act on the transfer belt. This causes local wear on the transfer belt, thereby irregularity in resistance affects transferability.

Japanese Patent Application Laid-Open No. 5-119636 discusses a method for decreasing wear due to deformation while deforming the sheet carrying the recording material to separate the recording material. Japanese Patent Application Laid-Open No. 5-119636 discusses a configuration in which a roller is provided as a lifting unit which can move to the positions where the transfer sheet is lifted from the inside and not lifted. In the method discussed in Japanese Patent Application Laid-Open No. 5-119636, the roller lifts the transfer sheet to separate the recording material. The transfer sheet is not lifted while the recording material is not separated.

If such a configuration is applied to the transfer belt, a lifting unit in which the roller can locally lift the transfer belt in a separating process is arranged on the downstream side of a transfer member which transfers a toner image to the recording material on the transfer belt in the direction in which the recording material is conveyed. In a case where the stiffness of a recording material such as thin paper is weak, a corrugation is provided on the recording material such that the recording material is conveyed with the transfer belt locally lifted, which allows the increase of stiffness of the recording material in the separating process.

A long space between rollers in the width direction produces an area where a corrugation is hard to be provided for the belt surface between the rollers. On the other hand, a short space between rollers in the width direction raises the belt surface between the rollers and makes unevenness on the belt surface small.

Thus, it is desirable to inhibit the belt surface between the rollers from rising producing a small unevenness on the belt surface even if the space between the rollers in the width direction is decreased.

On the other hand, even if the space between the rollers in the width direction is decreased, it is found that a space between the rollers in the direction in which the recording material is conveyed is increased to inhibit the belt surface from rising between the rollers.

SUMMARY OF THE INVENTION

The present invention is directed to an image forming apparatus capable of inhibiting a belt surface from rising between rollers and inhibiting of unevenness of the belt surface from becoming small if a space between the rollers in a width direction is decreased.

According to an aspect of the present invention, an image forming apparatus includes an image bearing member configured to carry a toner image, a rotatable belt member stretched by a plurality of stretching members and configured to carry and convey a recording material, a transfer member configured to transfer the toner image from the image bearing member to the recording material carried by the belt member by pressing the belt member against the image bearing member, a first lifting member arranged more downstream than the transfer member in a recording material conveyance direction, to which the recording material is conveyed, and configured to locally lift the belt member from the inside thereof in a width direction orthogonal to the recording material conveyance direction, a second lifting member arranged more downstream than the first lifting member in the recording material conveyance direction, to which the recording material is conveyed, arranged at a predetermined space from the first lifting member in the width direction orthogonal to the recording material conveyance direction, and configured to locally lift the belt member from the inside thereof in the width direction orthogonal to the recording material conveyance direction, and an execution unit for executing a mode in which the recording material is separated from the belt member by the first and second lifting members lifting the belt member.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

<Image Forming Apparatus>

Figure 1A:
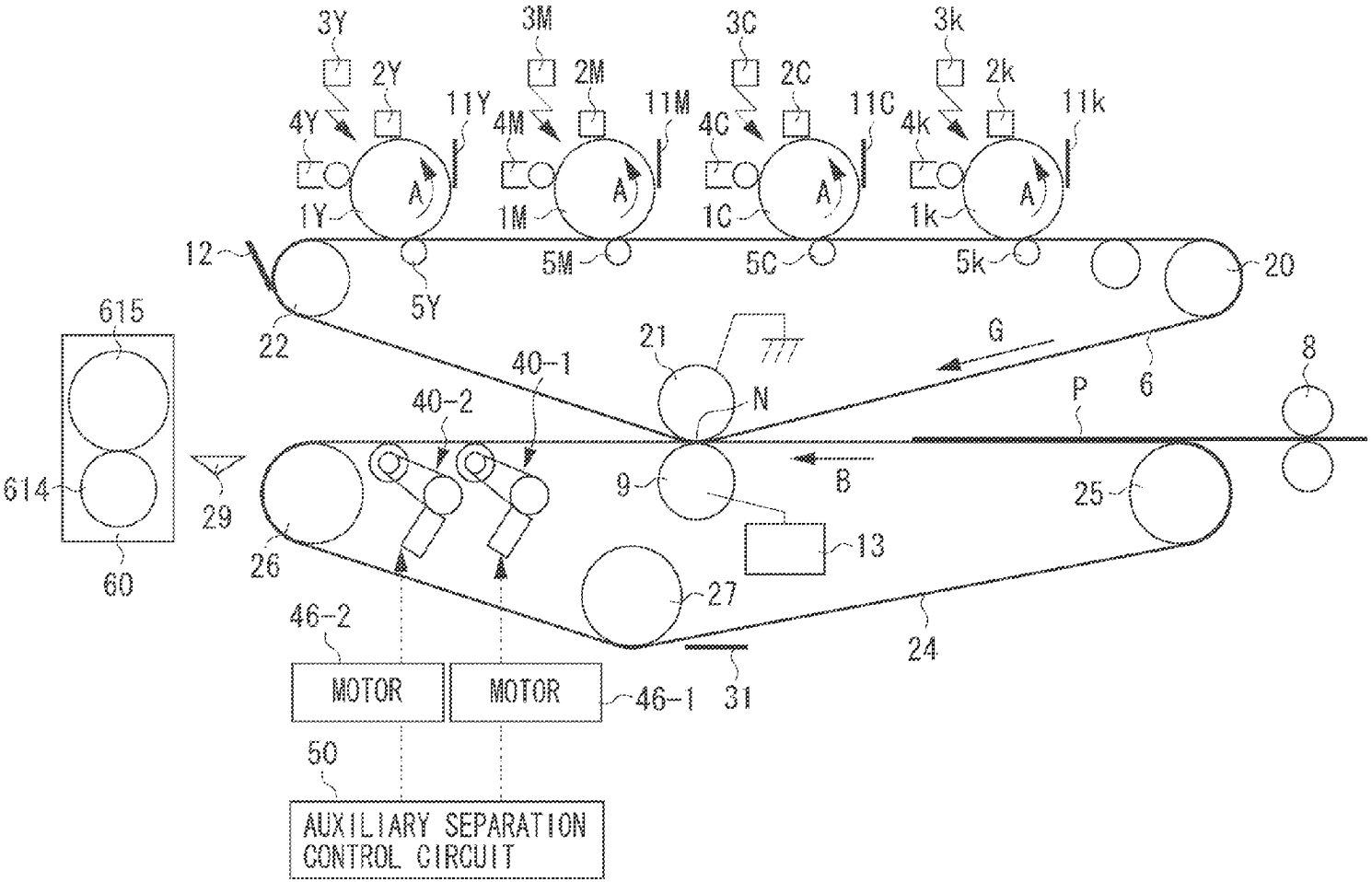
FIGS. 1A and 1B are schematic diagrams illustrating an image forming apparatus.
Figure 1B:
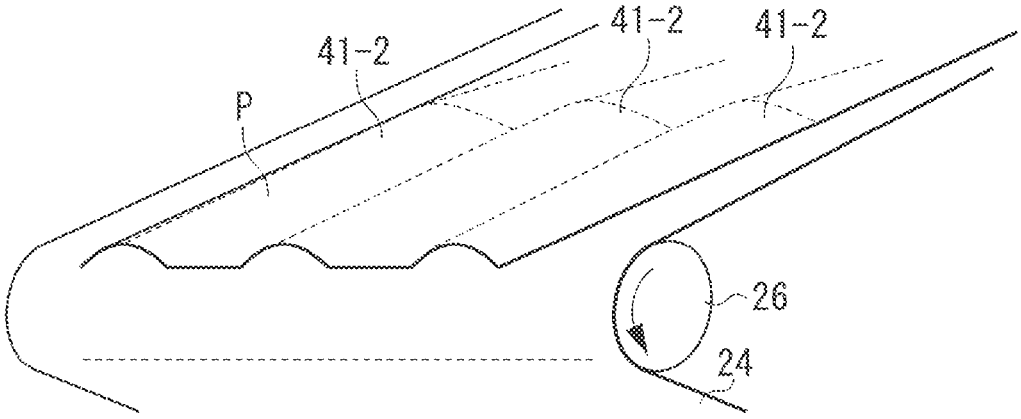

An image forming apparatus according to the present invention is described below. The configuration and operation of the image forming apparatus are described with reference to FIGS. 1A and 1B. The image forming apparatus illustrated in FIGS. 1A and 1B is a color image forming apparatus using an electrophotographic method. FIG. 1A is a cross section of an intermediate transfer tandem type image forming apparatus in which four color image forming units are arranged side by side on an intermediate transfer belt.

An image forming unit 100 is described first. The present exemplary embodiment includes known image forming units 100Y, 100M, 100C, and 100K. Each of the image forming units is described.

Photosensitive drums 1Y, 1M, 1C, and 1*k* are image bearing members capable of rotating in the direction indicated by an arrow A. Charging devices 2Y, 2M, 2C, and 2*k* charge the photosensitive drums 1Y, 1M, 1C, and 1*k* respectively. Exposure devices 3Y, 3M, 3C, and 3*k* expose the photosensitive drums 1Y, 1M, 1C, and 1*k* respectively based on input image information. Development devices 4Y, 4M, 4C, and 4*k* form toner images on the photosensitive drums 1Y, 1M, 1C, and 1*k* respectively. The development devices 4Y, 4M, 4C, and 4*k* develop the images using yellow (Y), magenta (M), cyan (C), and black (k) toners respectively. Cleaning devices 11Y, 11M, 11C, and 11*k* remove a residual toner on the photosensitive drums 1Y, 1M, 1C, and 1*k* respectively after a transfer process.

An intermediate transfer belt 6 serving as an intermediate transfer member or an image bearing member facing each of the photosensitive drums is described below. The intermediate transfer belt 6 is stretched by a plurality of stretching rollers 20, 21, and 22 serving as stretching members and rotated in the direction indicated by an arrow G. According to the present exemplary embodiment, the stretching roller 20 is a tension roller which applies tension to the intermediate transfer belt 6 to maintain tensile force of the intermediate transfer belt 6 constant. The stretching roller 22 is a drive roller for transmitting driving force to the intermediate transfer belt 6. The stretching roller 21 is an inner counter roller forming a secondary transfer unit. Inside the intermediate transfer belt 6 are provided primary transfer rollers 5Y, 5M, 5C, and 5*k* serving as primary transfer members for transferring the toner images formed on the respective photosensitive drums to the intermediate transfer belt 6. With using the above configuration, the four colored toner images are transferred to the intermediate transfer belt 6 in a superimposed manner and conveyed to a secondary transfer unit.

The configuration of the secondary transfer unit N for transferring the toner image formed on the intermediate transfer belt 6 to a recording material is described below. The secondary transfer unit N includes the inner counter roller 21 and an outer counter roller 9. The inner counter roller 21 serving as a first transfer member is provided inside the intermediate transfer belt 6. The outer counter roller 9 serving as a second transfer member presses the inner counter roller 21 from the outside of the intermediate transfer belt 6 via the intermediate transfer belt 6 and a transfer belt 24. A secondary transfer high voltage power supply 13 applies a voltage whose polarity is opposite to the normal charge polarity of the toner to the outer counter roller 9, so that the toner is transferred to the recording material. A conveyance unit for conveying the recording material is described below.

The toner image formed on the intermediate transfer belt 6 is secondarily transferred to the recording material which is sent from a registration roller 8 to the transfer belt 24 and conveyed to the secondary transfer unit N at a predetermined timing. Then, a recording material P is conveyed to a recording material guide 29 and further conveyed to a fixing device 60. The fixing device melts and fixes the toner image onto the recording material by applying thereto predetermined pressure force and heat quantity inside a fixing nip formed of a fixing roller 615 and a pressure roller 614 which oppose each other in FIG. 1.

<Configuration of Transfer Belt>

The transfer belt 24 is a movable belt member for carrying and conveying the recording material. The transfer belt 24 is stretched by a plurality of stretching rollers 25, 26, and 27 serving as stretching members and rotated in the direction indicated by an arrow B. According to the present exemplary embodiment, the stretching roller 26 is a drive roller for transmitting drive force to the transfer belt 24. The stretching rollers 25, 26, and 27 are rotated according to the rotation of the transfer belt 24. The stretching rollers 25, 26, and 27 are cylindrical.

The recording material P conveyed from the registration roller 8 starts abutting on the transfer belt 24 at the belt surface of the stretching roller 25 which is located more upstream than the secondary transfer unit N in the moving direction of the transfer belt 24. The configuration of the present exemplary embodiment does not include an attracting unit such as an attracting roller for electrostatically attracting the recording material to the transfer belt 24, however, the recording material P may be attracted to the transfer belt 24 using an attracting unit.

The recording material P put on the surface of the transfer belt 24 more upstream than the secondary transfer unit N is conveyed to the secondary transfer unit N along with the movement of the transfer belt 24. The toner image is transferred to the recording material P at the secondary transfer unit N and then the recording material P is separated from the transfer belt 24. In the present exemplary embodiment, if a grammage of the recording material P is greater than a predetermined value, auxiliary separation devices 40-1 and 40-2, which are described below, are not operated, and the recording material P is separated from the transfer belt 24 by the curvature of the stretching roller 26. Thus, the stretching roller 26 functions as a separation stretching member which can separate the recording material P carried by the transfer belt 24 from the transfer belt 24. On the other hand, if the grammage of the recording material P is smaller than the predetermined value, the auxiliary separation devices 40-1 and 40-2 are operated to separate the recording material P from the transfer belt 24.

The transfer belt 24 according to the present exemplary embodiment is formed of a material in which an appropriate amount of carbon black as an antistatic agent is included in resin, such as polyimide and polycarbonate, various rubbers, or the like. The transfer belt 24 has volume resistivity ranging from 1E+9 to 1E+14 (Ω·cm) and a thickness ranging from 0.07 to 0.1 mm. Further, an elastic member whose Young's modulus measured according to a tensile test method (JIS K 6301) is 0.5 MPa or more to 10 MPa or less is used as a material of the transfer belt 24. The use of a member whose Young's modulus in the tensile test for the transfer belt 24 is 0.5 MPa or more allows the belt to rotate while sufficiently maintaining a shape of the belt.

On the other hand, the use of a member whose Young's modulus is 10 MPa or less and which is flexible enough to be elastically deformed allows the below-described auxiliary separation device 40 to effectively generate a corrugation on the recording material P and to achieve the effective separation of the recording material P from the transfer belt 24. The member flexible enough to be elastically deformed tends to cause a relaxation phenomenon when a deformation volume of the member is reduced from a deformed state, so that the wear of the transfer belt 24 due to the auxiliary separation devices 40-1 and 40-2 can be reduced.

<Configuration of Auxiliary Separation Device 40-2>

In the present exemplary embodiment, the auxiliary separation devices 40-1 and 40-2 which separate the recording material P from the transfer belt 24 by locally lifting and deforming the transfer belt 24 in the width direction are provided as a lifting unit for lifting the transfer belt 24 to assist the separation of the recording material P from the transfer belt 24 (refer to FIG. 1A). The auxiliary separation devices 40-1 and 40-2 are provided inside the transfer belt 24 and more downstream than the secondary transfer roller 9 in the direction in which the recording material P is conveyed (i.e., recording material conveyance direction indicated by an arrow C). The auxiliary separation device 40-2 is provided more downstream than the auxiliary separation device 40-1 in the recording material conveyance direction. FIG. 1B illustrates a state in which the transfer belt 24 is locally lifted in the width direction by auxiliary separation rollers 41-2 of the auxiliary separation device 40-2.

Figure 2A:
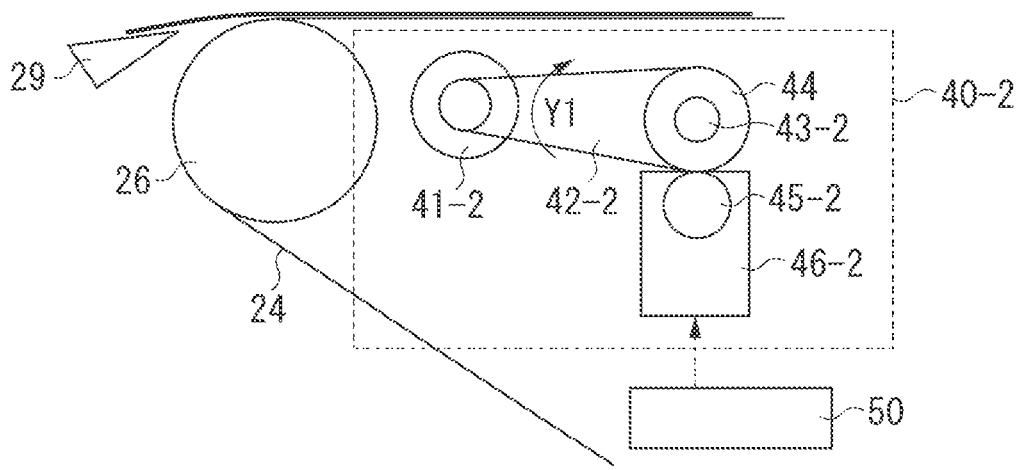
FIGS. 2A and 2B are cross sections of auxiliary separation devices.
Figure 2B:
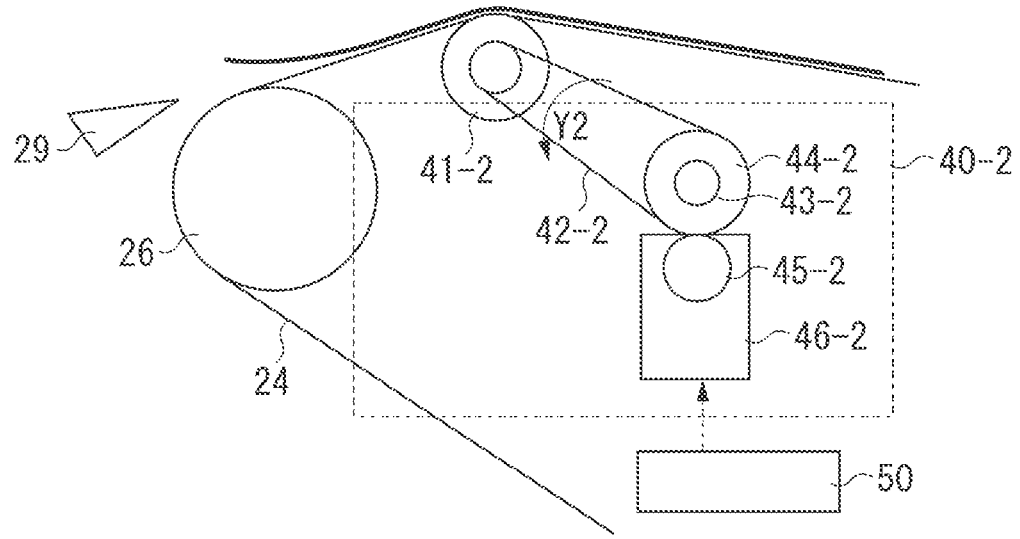

The auxiliary separation device 40-2 is described below. FIGS. 2A and 2B illustrate the detail configuration and operation of the auxiliary separation device 40-2. The auxiliary separation device 40-2 includes the auxiliary separation roller 41-2 serving as a second lifting member, a roller frame 42-2 for rotatably supporting the auxiliary separation roller 41-2, and a roller swing central axis 43-2 as a center of swing of the auxiliary separation roller 41-2. The auxiliary separation device 40-2 further includes a roller drive gear 44-2 for swing the auxiliary separation roller 41-2 around the roller swing central axis 43-2, a motor drive transmission gear 45-2 for transmitting drive force to the roller drive gear 44-2, and a motor 46-2 serving as a drive source.

The rotational movement of the motor 46-2 is transmitted to the roller drive gear 44-2 by the motor drive transmission gear 45-2. A bearing is provided between the roller drive gear 44-2 and the roller swing central axis 43-2, so that the roller swing central axis 43-2 is not affected by the rotational movement of the motor 46-2 and the position thereof is not moved.

FIG. 2A illustrates a retracting position where the auxiliary separation roller 41-2 is stored with the auxiliary separation roller 41-2 in a state separated from the transfer belt 24. FIG. 2B illustrates a lift position where the auxiliary separation roller 41-2 abuts on the inner surface of the transfer belt 24 to locally lift the transfer belt 24. The auxiliary separation roller 41-2 and the roller frame 42-2 are moved from the roller retracting position to the lift position in a direction Y1 by a predetermined amount of normal rotation of the motor 46-2 around the roller swing central axis 4-23. Further, the auxiliary separation roller 41-2 and the roller frame 42-2 can be moved from the lift position to the retracting position in a direction Y2 by a predetermined amount of reverse rotation of the motor 46-2. In other words, the auxiliary separation roller 41-2 to perform such a swing operation by the normal and the reverse rotation of the motor 46-2.

The auxiliary separation roller 41-2 is made of ethylene propylene rubber (EPDM) and has an outer diameter of 8 mm and a width of 10 mm. However, the outer diameter and the width of the auxiliary separation roller 41-2 are not limited to those values, and the outer diameter may be about 6 to 10 mm and the width may be about 5 to 15 mm. When such auxiliary separation roller 41-2 lifts the transfer belt 24, a local protrusion is formed on the transfer belt 24 in the width direction. The width direction refers to the direction orthogonal to the direction in which the belt surface is moved.

In FIG. 2A, a distance between the auxiliary separation roller 41-2 and the stretching roller 26 is 4 to 8 mm. In FIG. 2B, the auxiliary separation roller 41-2 lifts the belt surface of the transfer belt 24 from the inside by 3 to 6 mm from a planer state in FIG. 2A.

An electric charge whose polarity is opposite to that of the toner is applied to the inner surface of the transfer belt 24 by the secondary transfer roller 9, so that the recording material P is attracted by the transfer belt 24 at the transfer nip N and on the downstream side thereof. A recording material being weak in stiffness such as thin paper is likely to be deformed. Therefore, a corrugation is produced also on the recording material P along local protrusions produced by lift on the transfer belt 24 in the width direction. As a result, the moment of inertia of the recording material P, i.e., the stiffness thereof is increased. This provides separation effect effective to separate the recording material being weak in stiffness such as thin paper.

<Configuration of Auxiliary Separation Device 40-1>

The auxiliary separation device 40-1 is provided more upstream than the auxiliary separation device 40-2 in the recording material conveyance direction. The auxiliary separation device 40-1 is similar in configuration to the auxiliary separation device 40-2. More specifically, the auxiliary separation device 40-1 includes an auxiliary separation roller 41-1 serving as a first lifting member, a roller frame 42-1 for rotatably supporting the auxiliary separation roller 41-1, and a roller swing central axis 43-1 as a center of swing of the auxiliary separation roller 41-1. The auxiliary separation device 40-1 further includes a roller drive gear 44-1 for swing the auxiliary separation roller 41-1 around the roller swing central axis 43-1, a motor drive transmission gear 45-1 for transmitting drive force to the roller drive gear 44-1, and a motor 46-1 serving as a drive source. By the above configuration, the auxiliary separation roller 41-1 performs the swing operation similar to that of the auxiliary separation roller 41-2 illustrated in FIGS. 2A and 2B.

<Arrangement Relationship Between Auxiliary Separation Rollers 41-1 and 41-2>

An arrangement relationship between the auxiliary separation roller 41-1 of the auxiliary separation device 40-1 and the auxiliary separation roller 41-2 of the auxiliary separation device 40-2 is described below.

Figure 3:
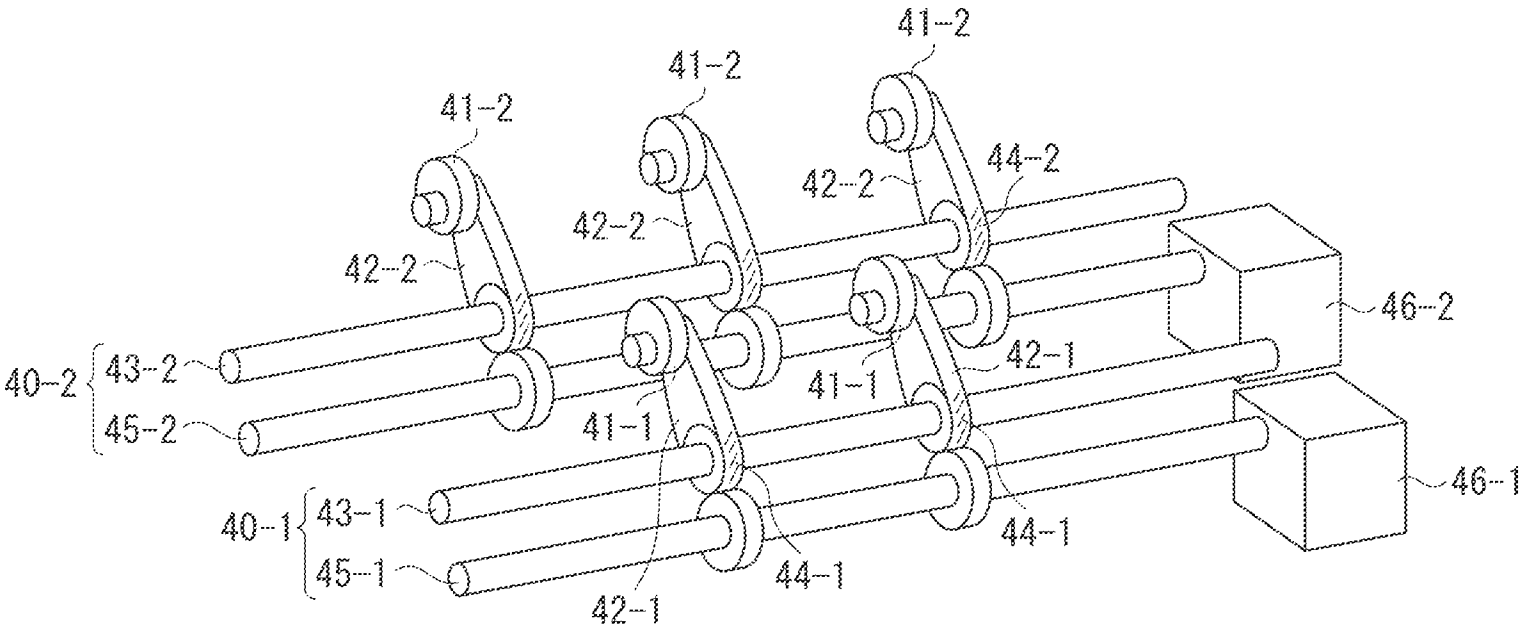
FIG. 3 is a perspective view of the auxiliary separation devices.

FIG. 3 is a perspective view of the auxiliary separation devices 40-1 and 40-2 in the present exemplary embodiment. According to the present exemplary embodiment, as illustrated in FIG. 3, three auxiliary separation rollers 41-2 are arranged in the width direction in the auxiliary separation device 40-2. The space between the auxiliary separation rollers 41-2 adjacent to each other in the width direction is 125 mm. The auxiliary separation roller 41-2 in the center is arranged to be positioned at a substantially center of the recording material P to be conveyed so that the center in the width direction of the recording material having any width can substantially coincide with a common reference line. In particular, in a case where an A-4 sized thin recording material being 297 mm in width is conveyed, a plurality of valley-like corrugations is formed on the A-4 sized recording material, so that the separability of the A-4 sized recording material can be increased.

In the present exemplary embodiment, although the space between the auxiliary separation rollers 41-2 adjacent to each other in the width direction is 125 mm, the space is not limited to this value, and may be set to a range of about 100 to 150 mm. When the space between the auxiliary separation rollers 41-2 adjacent to each other in the width direction is set to such a range and the belt surface is lifted by the auxiliary separation roller 41-2, large unevenness may be formed.

On the other hand, two auxiliary separation rollers 41-1 are arranged in the auxiliary separation device 40-1 in the width direction. The space between the auxiliary separation rollers 41-1 in the width direction is 125 mm. The center between the auxiliary separation rollers 41-1 in the width direction is arranged to be positioned at the substantially center of the recording material P to be conveyed so that the center in the width direction of the recording material having any width can substantially coincide with a common reference line. It is needless to say that the space between the auxiliary separation rollers 41-1 is not limited to the above mentioned value, and may be set to a range of about 100 to 150 mm.

In the present exemplary embodiment, the auxiliary separation roller 41-1 is arranged to coincide with the center portion between the auxiliary separation rollers 41-2 adjacent to each other when viewed from the recording material conveyance direction. A space between the auxiliary separation rollers 41-1 and 41-2 in the recording material conveyance direction is set to 60 mm. The reason for this setting is described below.

In the present exemplary embodiment, the transfer belt 24 is lifted by both of the upstream auxiliary separation roller 41-1 and the downstream auxiliary separation roller 41-2.

Figure 6A:
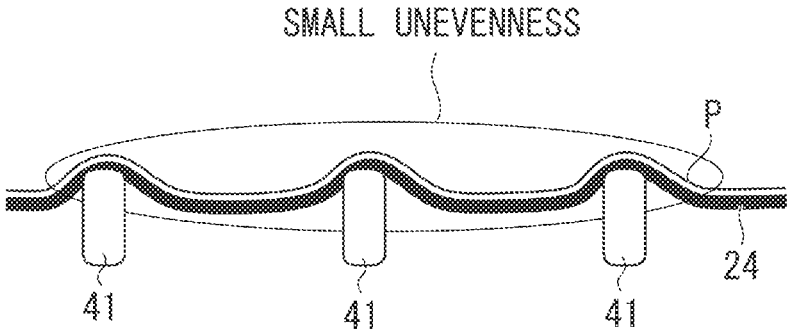
FIGS. 6A and 6B are schematic diagrams illustrating unevenness formed on a belt surface.
Figure 6B:
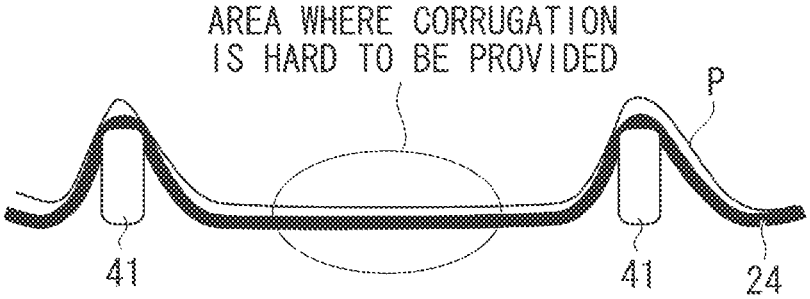

The increase of space between the auxiliary separation rollers in the width direction produces an area where a corrugation is hard to be produced on the belt surface between the auxiliary separation rollers (refer to FIG. 6B). On the other hand, the decrease of space between the auxiliary separation rollers in the width direction raises the belt surface between the auxiliary separation rollers. As a result, the unevenness on the belt surface is decreased (refer to FIG. 6A).

More specifically, a method is desired which can inhibits the belt surface between the auxiliary separation rollers from rising to decrease the unevenness of the belt surface even if the space between the auxiliary separation rollers in the width direction is decreased. Thus, according to the present exemplary embodiment, the space between the auxiliary separation rollers in the recording material conveyance direction is increased. As a result, the belt surface between the auxiliary separation rollers is inhibited from rising even if the space between the auxiliary separation rollers in the width direction is decreased, allowing large unevenness to be produced on the belt surface.

Figure 7A:
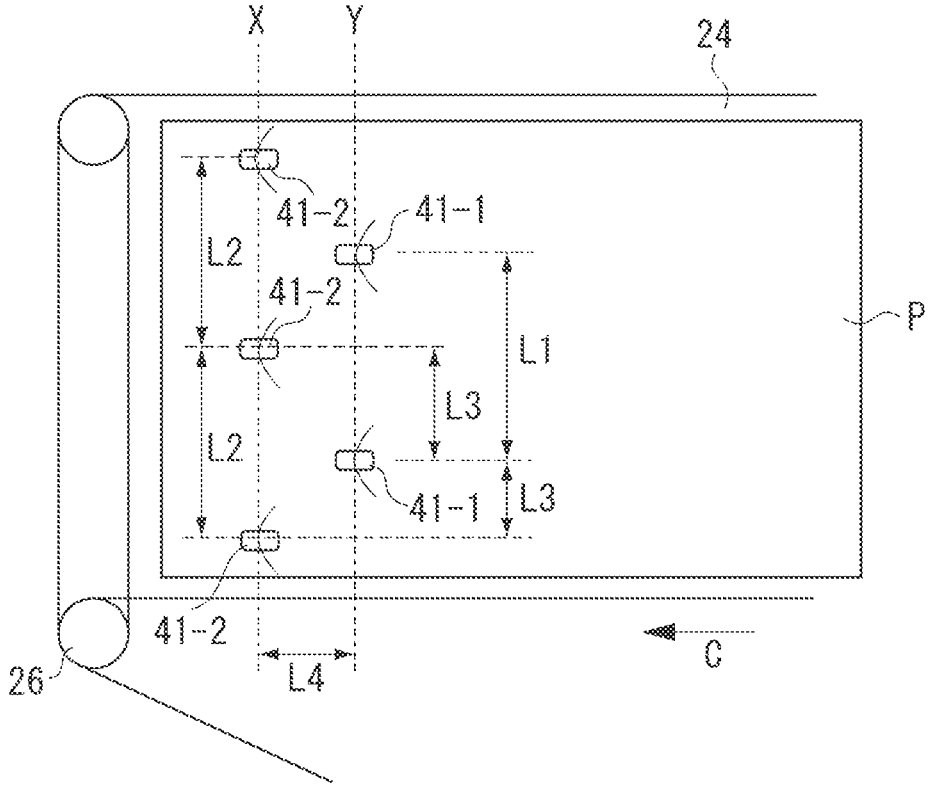
FIGS. 7A to 7C illustrate a corrugation on a recording material formed by two-stage auxiliary separation rollers.

FIG. 7A illustrates a state in which both of the auxiliary separation rollers 41-1 and 41-2 lift the transfer belt 24. A dotted line Y indicates the positions of the auxiliary separation rollers 41-1. A space L1 between the auxiliary separation rollers 41-1 is set to 125 mm which is a length such that the belt surface does not rise between the auxiliary separation rollers 41-1. A dotted line X indicates the positions of the auxiliary separation rollers 41-2. A space L2 between the auxiliary separation rollers 41-2 is also set to 125 mm which is a length such that the belt surface does not rise between the auxiliary separation rollers 41-2.

The auxiliary separation rollers 41-1 and 41-2 are alternately arranged when viewed from the recording material conveyance direction D. Since a space L3 between the auxiliary separation rollers 41-1 and 41-2 in the width direction is as small as 62.5 mm, a space L4 between the auxiliary separation rollers 41-1 and 41-2 in the recording material conveyance direction is set to 60 mm in the present exemplary embodiment. Such configuration can inhibit the belt surface from rising between the auxiliary separation rollers 41-1 and 41-2. According to the present exemplary embodiment, a space L1 is a length between the center positions of the auxiliary separation rollers 41-1 with respect to the width direction. A space L2 is a length between the center positions of the auxiliary separation rollers 41-2 with respect to the width direction, as well. A space L3 is a length between the center position of the auxiliary separation roller 41-1 and the center position of the auxiliary separation roller 41-2 with respect to the width direction, as well.

As described above, according to the present exemplary embodiment, three or more auxiliary separation rollers are used and the spaces L1, L2, and L3 in the width direction are different from one another. In this configuration, at least the auxiliary separation rollers between which the smallest space L3 among the spaces L1, L2, and L3 in the width direction is provided are separately arranged in the recording material conveyance direction.

In the present exemplary embodiment, importance is attached to inhibiting the belt surface from rising between the auxiliary separation rollers 41-1 and 41-2 and the space L4 between the auxiliary separation rollers 41-1 and 41-2 in the recording material conveyance direction is set rather long. As a result, in the recording material conveyance direction, a downstream end of a convex corrugation on the transfer belt 24 formed by the auxiliary separation roller 41-1 is formed more upstream than an upstream end of a convex corrugation formed by the auxiliary separation roller 41-2. However, the present invention is not limited to such a configuration. It may be difficult to increase the space in the recording material conveyance direction. In such a case, the space between the auxiliary separation rollers in the recording material conveyance direction may be set in an allowable range.

According to the present exemplary embodiment, the position of the downstream end of the convex corrugation formed on the transfer belt substantially coincides with that of the downstream end of the auxiliary separation roller, and the position of the upstream end of the convex corrugation formed on the transfer belt substantially coincides with that of the upstream end of the auxiliary separation roller. Accordingly, because the position of the downstream end of the upstream auxiliary separation roller 41-1 is more upstream than that of the upstream end of the downstream auxiliary separation roller 41-2 in the present exemplary embodiment, the position of the downstream end of the protrusion formed by the auxiliary separation roller 41-1 becomes more upstream than that of the upstream end of the protrusion formed by the auxiliary separation roller 41-2.

The increase of Young's modulus of the transfer belt 24 makes it easy to extend the convex portion formed on the transfer belt 24 in the recording material conveyance direction. In this case, the position of the downstream end of the convex corrugation on the transfer belt is positioned more downstream than that of the downstream end of the auxiliary separation roller, and the position of the upstream end of the convex corrugation on the transfer belt is positioned more upstream than that of the upstream end of the auxiliary separation roller. In this configuration, it is preferable that the space between the auxiliary separation rollers 41-1 and 41-2 in the recording material conveyance direction is further increased. As a result, the position of the downstream end of the protrusion formed by the auxiliary separation roller 41-1 becomes more upstream than that of the upstream end of the protrusion formed by the auxiliary separation roller 41-2.

Figure 7B:
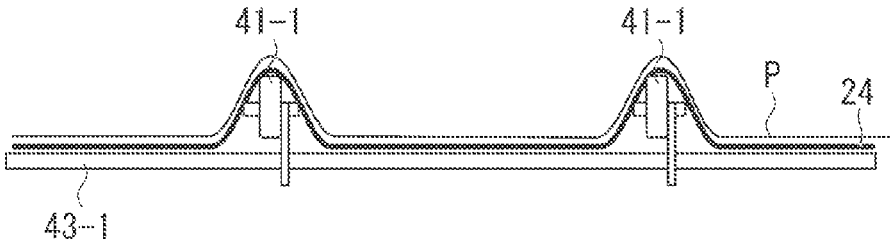
Figure 7C:
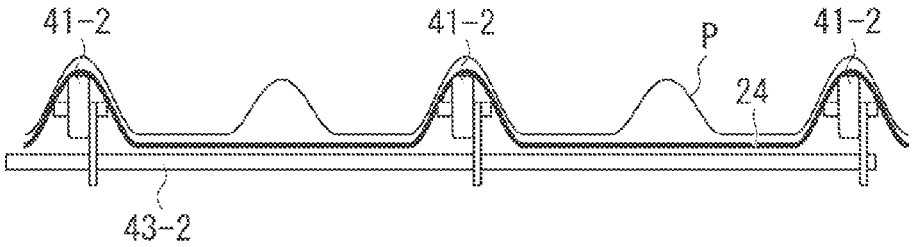

FIG. 7B is a cross section of the transfer belt 24 in the recording material conveyance direction in the position of the upstream auxiliary separation rollers 41-1 (the position of the dotted line Y in FIG. 7A). The two auxiliary separation rollers 41-1 arranged in the position of the dotted line Y form two convex corrugations on the recording material P which reaches the position of the dotted line Y. FIG. 7C is a cross section of the transfer belt 24 in the recording material conveyance direction in the position of the downstream auxiliary separation roller 41-2 (the position of the dotted line X in FIG. 7A).

The two convex corrugations formed by the upstream auxiliary separation rollers 41-1 remain on the recording material P even if the recording material P reaches the position of the dotted line X. The three auxiliary separation rollers 41-2 are arranged in the position of the dotted line X, and thus three convex corrugations are added to the recording material P which reaches the position of the dotted line X. This means that five convex corrugations are formed on the recording material P after the recording material P passes the position of the auxiliary separation rollers 41-2. Since the unevenness formed on the belt surface by the auxiliary separation rollers 41-1 and 41-2 is great, each convex corrugation formed on the recording material P by each auxiliary separation roller is also great.

<Operation Control of Auxiliary Separation Device>

Figure 4:
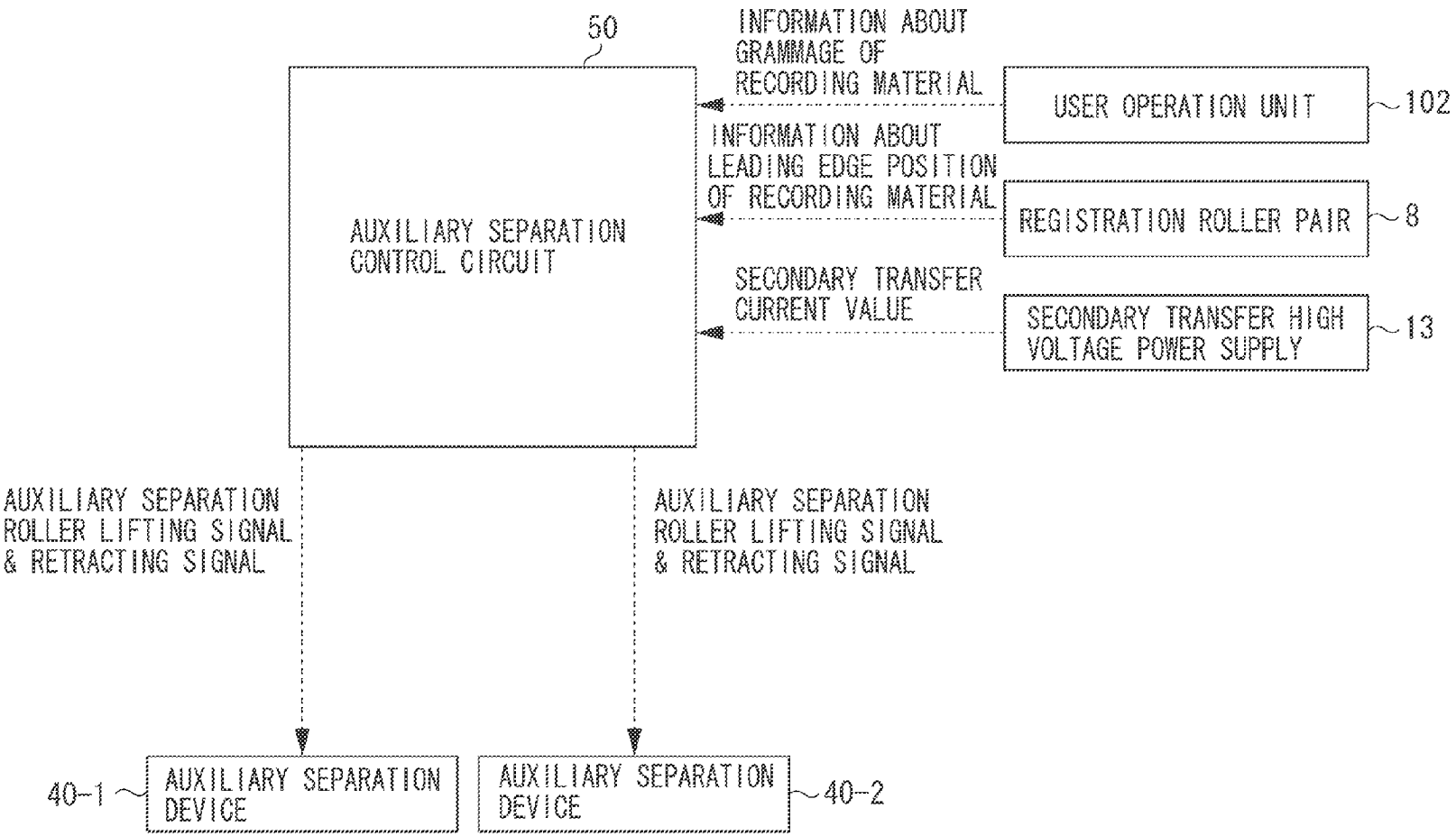
FIG. 4 illustrates an auxiliary separation control circuit.

The operation control of the auxiliary separation device is described below. The operation positions of the auxiliary separation devices 40-1 and 40-2 are controlled by an auxiliary separation control circuit 50. FIG. 4 illustrates the relation of the control. The control of operation position signals of the auxiliary separation devices 40-1 and 40-2 is based on information about grammage of the recording material P specified by a user and information about a position of a leading edge of the recording material which is acquired based on a timing of feeding the recording material P by the registration roller pair 8 and a conveyance speed of the recording material P.

The control circuit 50 includes a central processing unit (CPU), a read only memory (ROM), and a random access memory (RAM). Information from an operation unit 102 by which the user operates an image forming unit is input to the control circuit 50. The operation timing of the registration roller pair 8 is input to the control circuit 50. Information about a secondary transfer current value from the secondary transfer high voltage power supply 13 is input to the control circuit 50. The control circuit 50 transmits a lift signal acting as a trigger for an operation that the auxiliary separation roller lifts the transfer belt and a retracting signal for an operation that the auxiliary separation roller is retracted from the transfer belt to control the motors of the auxiliary separation devices 40-1 and 40-2.

Grammage is a unit of weight per unit area ($g/m^2$) and is generally used as a value indicating the thickness of a recording material.

In the present exemplary embodiment, the following two types of patterns are stored in the ROM in advance.

1) In a case where the grammage of a recording material is 40 $g/m^2$ or less, the auxiliary separation roller 41 is positioned in the lift position to locally protrude the transfer belt 24 in the width direction. The separation of the recording material P from the transfer belt 24 is performed by forming a local protrusion by the lift.

2) In a case where the grammage of a recording material is greater than 40 $g/m^2$, the auxiliary separation roller 41 is positioned in the retracting position. The auxiliary separation roller 41 is separated from the transfer belt 24 in the retracting position. The separation of the recording material P from the transfer belt 24 is performed by utilizing the curvature of the stretching roller 26.

More specifically, the recording material with a specific grammage (a first grammage) is subjected to an operation mode for lifting the auxiliary separation roller 41. The recording material with a second grammage greater than the first grammage is not subjected to the operation for lifting the auxiliary separation roller 41 but subjected to an operation mode for separating the recording material by the stretching roller 26. In other words, the auxiliary separation control circuit 50 functions as an execution unit for executing a separation mode.

The grammage of the recording material can be input by the user via the operation unit 102 or input to a storage unit for storing the recording material. The control unit 50 determines the operation of the auxiliary separation device 40 based on information about the grammage input to the image forming apparatus by the above manner.

Figure 5:
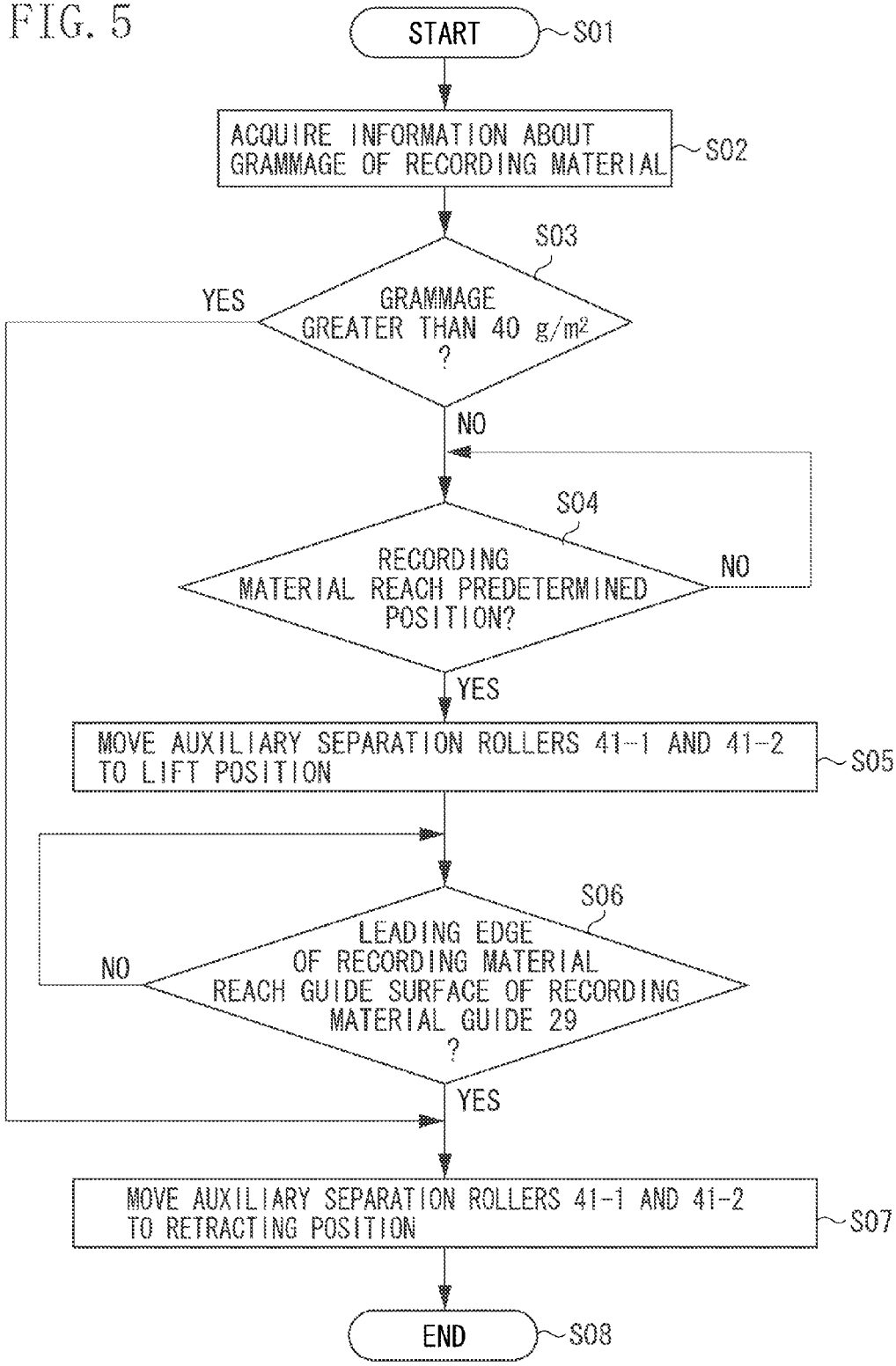
FIG. 5 is a flow chart for controlling the auxiliary separation device.

The flow chart of the operation control of the auxiliary separation devices 40-1 and 40-2 is described below with reference to FIG. 5. In step S01, the operation control is started. In step S02, information about the grammage of the recording material set by the user via the user operation unit 102 is read. In step S03, it is determined whether the grammage is greater than 40 $g/m^2$. If the grammage of the recording material P is greater than 40 $g/m^2$ (YES in step S03), then in step S07, the auxiliary separation roller is arranged in the retracting position to retract from the transfer belt.

If the grammage of the recording material P set by the user is 40 $g/m^2$ or smaller (NO in step S03), the operation is required in which the auxiliary separation rollers 41-1 and 41-2 lift the transfer belt 24 to form local protrusions in order to separate the recording material which is small in stiffness from the transfer belt 24. If the grammage of the recording material P set by the user is 40 $g/m^2$ or smaller, then in step S04, it is determined whether the recording material P reaches a predetermined position.

The predetermined position is set more upstream than the upstream auxiliary separation roller 41-1 in the recording material conveyance direction and set so that the operation of the auxiliary separation roller 41-1 lifting the transfer belt 24 is completed before the leading edge of the recording material reaches the position where the upstream auxiliary separation roller 41-1 lifts the transfer belt 24. The position of the recording material is determined by detecting the time elapsed after the recording material passes the registration roller and the conveyance speed of the recording material or by arranging a detection member for detecting the passage of the recording material.

If it is determined that the recording material P reaches the predetermined position (YES in step S04), in step S05, the auxiliary separation rollers 41-1 and 41-2 are simultaneously moved in the direction Y1 and arranged to the lift position where the transfer belt 24 is lifted.

The recording material P is provided with a corrugation on the transfer belt 24 deformed by the auxiliary separation rollers 41-1 and 41-2 to increase the stiffness thereof and separated from the transfer belt 24 before the transfer belt 24 reaches the area abutting on the stretching roller 26. In step S06, it is determined whether the leading edge of the recording material P reaches the guide surface of the recording material guide 29. The position of the recording material is determined by detecting the time elapsed after the recording material passes the registration roller and the conveyance speed of the recording material or by arranging a detection member for detecting the passage of the recording material.

If the leading edge of the recording material P reaches the guide surface of the recording material guide 29 (YES in step S06), then in step S07, it is determined that separation is performed and the auxiliary separation rollers 41-1 and 41-2 are moved to the retracting position. In step S08, the processing is ended.

According to the present exemplary embodiment, the control is performed based on the information about grammage input by the user, however, the grammage of the recording material may be determined by a sensor provided to the image forming apparatus. If the operation of the auxiliary separation device 40 is controlled based on the grammage determined by the sensor, the lift operation may be performed even if the recording material with small grammage is incorrectly stored in the cassette for the recording material with great grammage. In other words, even if the recording material with small grammage is stored in the incorrect position, the separation defect can be prevented from occurring in the recording material with small grammage.

As another sensor, a weight sensor for detecting the weight of the recording material to be conveyed may be provided on the conveyance path for the recording material. The grammage of the recording material may be determined based on the weight detected by the weight sensor and information about the size (area) of the recording material. Alternatively, a transmission sensor for detecting light transmissivity may be provided on the conveyance path for the recording material to determine the thickness of the recording material from the transmissivity of the light transmitted through the conveyed recording material.

According to the present exemplary embodiment, the simplicity of the control is prioritized to perform both of the lift operation and the retracting operation of the auxiliary separation rollers 41-1 and 41-2 at the same time. However, the present invention is not limited to the above control. The timing at which the downstream auxiliary separation roller 41-2 is lifted may be set to the timing later than that at which the upstream auxiliary separation roller 41-1 is lifted and before the leading edge of the recording material reaches the downstream auxiliary separation roller 41-2.

The lift of the transfer belt by the auxiliary separation roller wears the transfer belt. It is desirable to shorten the time period in which the auxiliary separation roller 41 lifts the transfer belt to suppress the wear. By delaying the timing at which the downstream auxiliary separation roller 41-2 lifts the transfer belt, the wear of the transfer belt due to the downstream auxiliary separation roller 41-2 can be inhibited.

The timing at which the upstream auxiliary separation roller 41-1 performs the retracting operation may be set earlier than the timing at which the downstream auxiliary separation roller 41-2 performs the retracting operation. The lift of the transfer belt by the auxiliary separation roller wears the transfer belt. It is desirable to shorten the time period in which the auxiliary separation roller 41-1 lifts the transfer belt to suppress the wear. Thus, by advancing the timing at which the auxiliary separation roller 41-1 is retracted from the transfer belt, the wear of the transfer belt due to the upstream auxiliary separation roller 41-1 can be inhibited.

A second exemplary embodiment is described below. The description of the configuration of the second exemplary embodiment overlapping with that of the first exemplary embodiment is omitted. In the second exemplary embodiment, the control circuit 50 performs the operation control of the auxiliary separation devices 41-1 and 41-2 based on information about the size of the recording material in the width direction. More specifically, information about the size of the recording material in the width direction is read. In a case where the information about the size of the recording material in the width direction is 200 mm or smaller, the auxiliary separation roller 41-1 lifts the transfer belt 24, and the auxiliary separation roller 41-2 stands by in the retracting position. In a case where the information about the size of the recording material in the width direction is 200 mm or greater, both of the auxiliary separation rollers 41-1 and 41-2 lift the transfer belt 24.

The reason for this setting is described below. If the size of the recording material in the width direction is 200 mm or greater, the auxiliary separation rollers 41-2 on the end side in the width direction are outside the area where the recording material P passes. As a result, the surplus lift of the auxiliary separation rollers 41-2 outside the area where the recording material P passes uselessly wears the transfer belt. Therefore, the auxiliary separation rollers 41-2 is lifted based on the information about the size of the recording material in the width direction in order to inhibit the transfer belt from being uselessly worn due to the auxiliary separation rollers 41-2.

Figure 8:
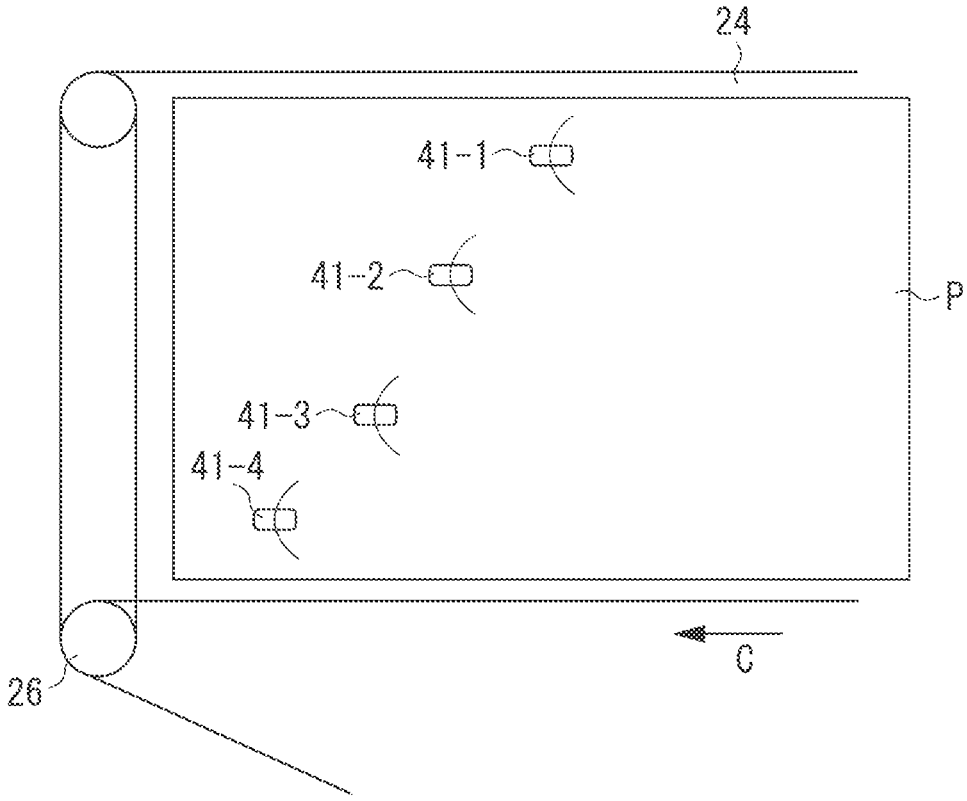
FIG. 8 illustrates a third exemplary embodiment of the present invention.

A third exemplary embodiment is described below. The description of the configuration of the third exemplary embodiment overlapping with that of the first exemplary embodiment is omitted. The third exemplary embodiment is different from the first exemplary embodiment in the arrangement of the auxiliary separation rollers 41. As illustrated in FIG. 8, in the present exemplary embodiment, the auxiliary separation rollers has a four-stage structure in which rollers 41-1, 41-2, 41-3, and 41-4 are arranged in order from the upstream in the recording material conveyance direction. The auxiliary separation rollers 41-1, 41-2, 41-3, and 41-4 are equally spaced in order from the end in the width direction when viewed from the recording material conveyance direction.

Although the space between the adjacent auxiliary separation rollers in the width direction when viewed from the recording material conveyance direction is small, components in the recording material conveyance direction are set greater. Accordingly, the belt surface can be inhibited from rising between the auxiliary separation rollers which are adjacent when viewed from the recording material conveyance direction. As a result, large unevenness can be formed on the belt surface by the auxiliary separation rollers.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2010-258189 filed Nov. 18, 2010, which is hereby incorporated by reference herein in its entirety.

What is claimed is:

1. An image forming apparatus comprising: an image bearing member configured to carry a toner image;

a rotatable belt member stretched by a plurality of stretching members and configured to carry and convey a recording material;

a transfer member configured to transfer the toner image from the image bearing member to the recording material carried by the belt member by pressing the belt member against the image bearing member;

a first separation portion disposed downstream of the transfer member in a conveying direction of a recording material, configured to form a first protruded portion on the belt member in a thickness direction of the belt member, and configured to form a first convex corrugation on the recording material carried by the belt member corresponding to the first protruded portion in a width direction of the belt member;

a second separation portion disposed downstream of the first separation member in the conveying direction, configured to form a second protruded portion on the belt member in the thickness direction, and configured to be disposed so as not to overlap the first separation portion in the width direction, and configured to form a second convex corrugation on the recording material carried by the belt member corresponding to the second protruded portion in a width direction in a state that the recording material keeps the first convex corrugation;

wherein each of the first and the second separation portions includes a plurality of separation rollers extending in the width direction of the belt member; and wherein each of the separation rollers have an outer diameter of not less than 6 mm and not more than 10 mm, and a width in the width direction of not less than 5 mm and not more than 15 mm.

2. The image forming apparatus according to claim 1, wherein the first and the second separation portions are disposed so that a downstream end of the first protruded portion is positioned more upstream than an upstream end of the second protruded portion in the conveyance direction.

3. The image forming apparatus according to claim 1, wherein a Young's modulus of the belt member is not less than 0.5 MPa and not more than 10 MPa.

4. The image forming apparatus according to claim 1, wherein a plurality of stretching members include a stretching roller configured to be disposed at an area where a recording material carried by the belt member is separated from the transfer belt, and the first and the second separation portions are disposed downstream of the transfer member and upstream of the stretching roller in the conveying direction.

5. The image forming apparatus according to claim 1, further comprising a third separation portion disposed at a same position as the first separation portion in the conveyance direction, configured to form a third protruded portion on the belt member in the thickness direction, and configured to be disposed so as not to overlap the second separation portion in the width direction, wherein the second separation portion is disposed between the first separation portion and the third separation portion in the width direction, and configured to form a third convex corrugation on the recording material carried by the belt member corresponding to the third protruded portion in the width direction.

6. The image forming apparatus according to claim 5, wherein a distance between the first separation portion and the third separation portion in the width direction is not less than 100 mm and not more than 150 mm.

7. The image forming apparatus according to claim 5, wherein the second separation portion is disposed substantially at a center between the first separation portion and the third separation portion in the width direction.

8. The image forming apparatus according to claim 5, wherein in an area of the recording material where the first convex corrugation, the second convex corrugation, and the third convex corrugation are formed in the width direction, and a stiffness of a recording material passed through the second separation portion in the conveyance direction increases due to the convex corrugations to separate the recording material from the belt member.

9. The image forming apparatus according to claim 1, further comprising an execution portion configured to execute a first mode in which the first and the second separation portions push up the belt member from the inside thereof so as to form the first and the second protruded portions on the belt member, and a second mode in which both the first and the second separation portions are retracted from the belt member.

10. The image forming apparatus according to claim 9, wherein in the first mode, timing at which the first separation portion pushes up the belt member is earlier than timing at which the second separation portion pushes up the belt member.

11. The image forming apparatus according to claim 9, wherein an amount of a displacement, from the second mode to the first mode, of a surface position of the belt member in the thickness direction at the first and the second separation portion is not less than 3 mm and not more than 6 mm.

12. The image forming apparatus according to claim 9, further comprising an input portion configured to input information about stiffness of a recording material, wherein the execution portion executes the first mode in a case where the stiffness of the recording material is less than a predetermined stiffness.

* * * * *